United States Patent [19]

Scott

[11] 4,169,504

[45] Oct. 2, 1979

[54] FLUID INTRODUCTION UNIT FOR WELLS

[75] Inventor: Raymond L. Scott, Houston, Tex.

[73] Assignee: Wellhead Control Systems, Inc., Houston, Tex.

[21] Appl. No.: 868,792

[22] Filed: Jan. 12, 1978

[51] Int. Cl.[2] ..... E21B 33/03

[52] U.S. Cl. ..... 166/90; 285/150

[58] Field of Search ..... 166/86-90, 166/75, 95, 312; 175/207, 214; 366/341; 285/150, 155

[56] References Cited

U.S. PATENT DOCUMENTS

| | | | |
|---|---|---|---|
| 1,362,718 | 12/1920 | McNamara | 285/155 X |
| 1,566,419 | 12/1925 | O'Neill et al. | 166/90 |
| 1,582,238 | 4/1926 | Arbon | 166/90 |
| 1,659,452 | 2/1928 | Welton | 166/95 |
| 1,963,046 | 6/1934 | Bouslog | 166/88 |
| 3,763,936 | 10/1973 | Menage | 166/90 |
| 3,943,997 | 3/1976 | Davis | 166/90 |

*Primary Examiner*—James A. Leppink
*Assistant Examiner*—Richard E. Favreau
*Attorney, Agent, or Firm*—Pravel, Gambrell, Hewitt, Kirk, Kimball & Dodge

[57] ABSTRACT

A fluid introduction unit adapted to be mounted in a well production flow assembly, sometimes referred to as a christmas tree, for the introduction of highly corrosive fluids into high pressure wells without damaging the production tubing.

4 Claims, 2 Drawing Figures

L
S
C-1
20
21
22
19
18a
14
16
10c
10
18b
10a
30
10b
38
18c
28
31
30
33
35
32
18d
0
32a
35

18e
10d
40
36a
34a
42
36b
34b
26
25
23
24
C-2

18a
22
10
37
32
32a
37
31
30
45
33
44
38
46
10b

FLUID INTRODUCTION UNIT FOR WELLS

BACKGROUND OF THE INVENTION

The field of this invention is a fluid introduction unit adapted for use in high pressure wells which require the introduction of highly corrosive fluids for well treatment purposes.

The use of various corrosive fluids, such as fluids containing sand, for fracturing, acidizing or other treatment of high pressure wells is part of the present well treatment technology. Generally, such corrosive fluids are introduced into a housing mounted in line with other production wellhead equipment having production tubing extending through a common central bore. In the past, the introduction of well treatment fluids through such housings has caused damage to the production tubing extending through the common bore, particularly due to the impingement of such corrosive fluids against the production tubing.

One way to avoid this problem has been to simply remove the production tubing prior to fracturing. This is an expensive operation requiring the well to be "killed." The killing of a well is accomplished by introducing extremely heavy fluids into the well, which fluids must be removed before production can resume. Removal of the heavy fluids is expensive, and, occasionally, problems are encountered in reviving such wells to production.

SUMMARY OF THE INVENTION

The new, improved fluid introduction unit of this invention provides for the introduction of well treatment fluids, which may be corrosive, into a high pressure well without damage to the production tubing. Using the fluid introduction unit of the invention, the corrosive fluids can be injected (1) while the production tubing is still in place, and (2) without having to "kill" the well.

The fluid introduction unit of the preferred embodiment of this invention is adapted for mounting in the production wellhead assembly and includes a housing having a central bore extending longitudinally through the housing for receiving the production tubing which extends into the well. The housing, further, has an external mount means positioned radially outwardly with respect to the longitudinal axis of the unit, the external mount means being adapted to receive and mount flow control valving for the introduction of well treatment fluids into the well. The unit also contains a fluid introduction bore extending from the external mount means to the central housing bore at an inclined angle with respect to the axis of the bore and opening tangentially at the bore wall whereby entering fluid is tangentially injected and is directed helically downward into the well casing without impinging on the production tubing. This summary of the invention is not intended to be exhaustive of the patentable features of this invention which are set forth in the claims.

DESCRIPTION OF THE PREFERRED EMBODIMENT

Figure 1:
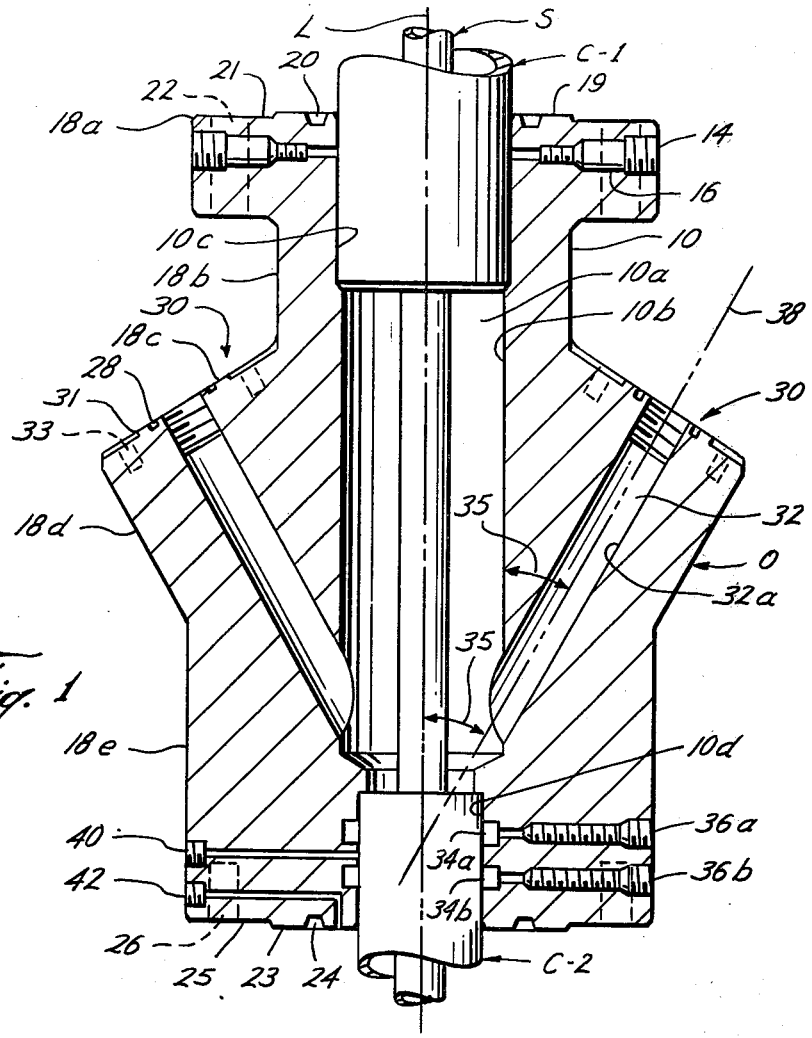
FIG. 1 is a side, sectional view of the fluid introduction unit of the preferred embodiment of this invention, illustrating the relationship of the fluid introduction bore to the central housing bore; and, FIG. 2 is a top view of the fluid introduction unit further illustrating the relationship of the fluid introduction bore to the central housing bore.

The fluid introduction unit, generally designated by the letter U, of the preferred embodiment of this invention is adapted for use in high pressure wells which require the introduction of well treatment fluids, which may be highly corrosive. The fluid introduction unit U is normally mounted in production wellhead equipment, sometimes referred to as a "christmas tree," and it is ordinarily placed in about the middle of the christmas tree stack. Well treatment of some high pressure wells, such as by fracturing or acidizing, requires the introduction of corrosive fluids into the christmas tree bore for flow downwardly into the well. For example, the corrosive fluid normally used to fracture high pressure wells is a high density emulsion of sand and oil; however, the corrosive fluids may include gases, liquids, emulsions, slurries or finely divided particulate matter. The fluid introduction unit U may be used in the treatment of high pressure wells without removing the production tubing string and without killing the well.

The fluid introduction unit U includes a housing 10 having a central housing bore **10*a* generally extending longitudinally therethrough about longitudinal axis L. The central housing bore 10*a* is formed by a generally cylindrical wall 10*b* having a diameter which conforms approximately to the outside diameter of the well casing members C-1 and C-2. The upper part of the central housing bore 10*a* includes bore portion 10*c* which receives the upper well casing C-1, extending through an upper section of the christmas tree (not shown). A plurality of casing hanger tie-down pins 14 are located in the horizontal plane of an upper mounting flange portion 18*a* of the housing 10. The casing hanger tie-down pins 14 are threaded in set-screw fashion in radially directed casing hanger tie-down bores 16** to mechanically retain the well casing C-1.

A lower bore portion **10*d* of the central housing bore 10*a* is reduced in diameter and supports the lower casing C-2. Two mechanical seal means 34*a* and 34*b* are positioned in the bore portion 10*d* for sealing against the passage of fluid between the wall of bore portion 10*d* and the outside wall of casing C-2. The mechanical seals 34*a* and 34*b* are physically tightened around the lower well casing C-2 by set screws 36*a* and 36*b*. Seal testing bores 40 and 42 are machined in the housing 10 for testing mechanical seals 34*a* and 34*b*. The mounting of the upper and lower casings C-1 and C-2 is known in the art. Production tubing S extends through housing bore 10*a*** downwardly into the well in a known manner.

The housing 10 of the fluid introduction unit U includes an upper flanged portion **18*a* which merges into an intermediate cylindrical portion 18*b*. An outwardly inclined portion 18*c* extends outwardly from cylindrical portion 18*b* and an inwardly inclined portion 18*d* joins inclined portion 18*c* to a lower cylindrical portion 18*e*. The outer diameter of lower cylindrical portion 18*e* is greater than the outer diameter of intermediate portion 18*b*. The longitudinal axis L of bore 10*a* is coextensive with the longitudinal axis of the housing 10 including cylindrical portions 18*b* and 18*e***.

The upper flanged portion **18*a* includes an upper, annular flange mounting surface 19 concentric to longitudinal axis L and having an annular seal recess 20 with an annular flat portion 21 with circumferentially spaced bolt openings 22 therein. The outer diameter of the upper flange mounting surface 19 is approximately equal to the diameter of the housing intermediate cylindrical portion 18***b*.

A lower horizontal mounting face 23 faces downward and is generally concentric to the longitudinal axis L of the central housing bore 10*a*. The lower horizontal mounting face 23 has an annular seal recess 24 and a flat annular mounting face 25. The mounting face 25 includes a plurality of circumferentially spaced stud holes 26. The mounting face 23 has an outer diameter which is approximately the same as the diameter of the outer surface of the housing intermediate cylindrical portion 18*b*.

An external mount means generally designated as 30 is positioned radially outward with respect to the longitudinal axis L of the central housing bore 10*a* and is adapted to receive and mount flow control valving (not shown). The external mount means 30, which is a part of housing portion 18*c*, includes truncated conical face 31 inclined downwardly with respect to the longitudinal axis L of the central housing bore 10*a*. Four fluid introduction bores 32 extend from the face 31 to the central housing bore 10*a* at an inclined angle 35 with respect to the longitudinal axis L of the central housing bore 10*a*. Each fluid introduction bore 32 opens to external mount means face 31 at a right angle thereto and opens to the wall 10*b* of the bore 10*a* at inclined angle 35 with respect thereto (FIG. 1) and tangentially with respect to the circular bore wall 10*b* (FIG. 2).

The external mounting face 31 contains a plurality of stud holes 33 positioned circumferentially about each fluid introduction bore 32. The purpose of the stud holes 33 is to mount flow control valving thereto. The face 31 also includes an annular seal recess 28, which recess holds in place an O-ring type seal.

Each of the fluid introduction bores 32 are straight and may be defined as having a longitudinal axis along a straight line 38. The bore axis line 38, as viewed in FIG. 1, appears to intersect the central housing bore longitudinal axis L at angle 35. The fluid introduction bore axis 38, however, does not actually intersect central housing bore axis L because the fluid introduction bore 32, as illustrated in FIG. 2, is not radially oriented. The fluid introduction bore axis 38 does intersect the central housing bore wall 10*b* at angle 35.

Figure 2:
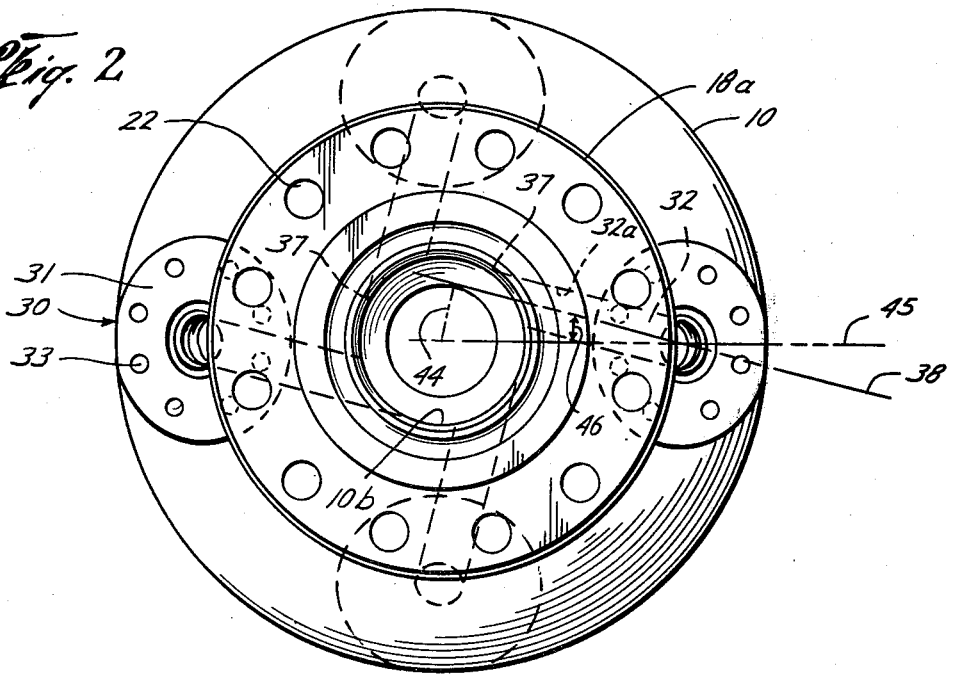

Referring to FIG. 2, the fluid introduction bores 32 actually extend tangentially to the central housing bore wall 10*b* and thus the axis 38 of each fluid introduction bore 32 actually is a right angle with respect to the shortest radius 44 of the longitudinal axis L of central housing bore 10*a*.

Each of the fluid introduction bores 32 may be defined as having a bore wall 32*a*, a portion of which is actually tangential to the central housing bore wall 10*b* at locus 37. Referring to FIG. 2 again, each bore axis 38 intersects a radius 45 from the central housing bore axis L to the point of opening of bore 32 to face 31 at an acute angle 46.

The embodiment illustrated in FIGS. 1 and 2 includes four fluid introduction bores 32; however, it is within the scope of this invention to utilize any number of said bores. If more than one fluid introduction bore 32 is used such as illustrated here, each such bore is non-radially directed along angle 46 in the same direction so that fluid entering each fluid introduction bore 32 flows in the same circular and helical direction downwardly through the central housing bore 10*a*.

Well treatment fluid, which may be corrosive, enters each bore 32 from the valving mounted on face 31. The fluid flows downwardly through the fluid introduction bores 32 and enters the central housing bore 10*a* tangentially with respect to the radius 44. The fluid entering the central housing bore 10*a* tangentially is directed downwardly at angle 35 with respect to the longitudinal axis L (FIG. 1). Thus, fluid entering bore 10*a* is directed tangentially (FIG. 2) and inclined downwardly (FIG. 1) so that the flow is circular and generally helically directed downwardly about the bore wall 10*a* into the well below. In this manner, the fluid entering central housing bore 10*a* does not flow radially into impinging contact with tubing S thereby substantially eliminating any corrosive damage to the production tubing S.

The foregoing disclosure and description of the invention are illustrative and explanatory thereof, and various changes in the size, shape and materials as well as in the details of the illustrated construction may be made without departing from the spirit of the invention.

I claim:

1. A fluid introduction unit adapted for use in high pressure wells which require the introduction of corrosive fluids for well treatment purposes, comprising:

a fluid introduction housing adapted for mounting on a well production flow control assembly, said fluid introduction housing having a central housing bore extending longitudinally therethrough, said bore axis being coextensive with the longitudinal axis of said housing, said central housing bore being formed by a generally cylindrical wall and being adapted to receive production tubing which extends into the well;

said fluid introduction housing having an external mount means positioned radially outward with respect to the longitudinal axis of said housing, said external mount means being adapted to receive and mount flow control valving for the introduction of fluids into said housing;

said fluid introduction housing having a fluid introduction bore extending from said external mount means to said central housing bore at an inclined angle to the longitudinal axis of said central housing bore, said fluid introduction bore being oriented for tangential entry into the central housing bore whereby entering fluid is passed through said fluid introduction bore and enters said central housing bore tangentially to said central housing bore wall causing the fluid to flow helically downward thereby eliminating deleterious impingment of said entering fluid upon such production tubing positioned in said central housing bore.

2. The structure set forth in claim 1, wherein said external mount means includes:

a mounting surface outwardly inclined with respect to the longitudinal axis of said central housing bore, said fluid introduction bore opening to said mounting surface at a right angle thereto.

3. The structure set forth in claim 1, including:

said fluid introduction housing having a second external mount means positioned radially outward with respect to the longitudinal axis of said housing, said second external mount means being adapted to receive and mount second flow control valving for the introduction of fluids into said housing;

said fluid introduction housing having a second fluid introduction bore extending from said second external mount means to said central housing bore at an inclined angle to the longitudinal axis of the bore, said second fluid introduction bore being oriented for tangential entry into the central housing bore whereby entering fluid is passed through said fluid introduction bore enters said central housing bore tangentially to said central housing bore wall to cooperate with said first mentioned fluid introductión bore to cause fluid entering said central housing bore to flow helically downward thereby eliminating deleterious impingement of said entry fluid upon production tubing positioned in said central housing bore.

4. The structure set forth in claim 3, including:

for each fluid introduction bore, as viewed from above, said fluid introduction bores being non-radially directed and oriented tangentially in the same direction with respect to said bore wall.

* * * * *